US011694661B1

(12) United States Patent
Astfalk

(10) Patent No.: US 11,694,661 B1
(45) Date of Patent: Jul. 4, 2023

(54) MELODIC BEND HARMONICA

(71) Applicant: Brian Astfalk, Tucson, AZ (US)

(72) Inventor: Brian Astfalk, Tucson, AZ (US)

(73) Assignee: Brian Astfalk, Tucson, AZ (US)

( * ) Notice: Subject to any disclaimer, the term of this patent is extended or adjusted under 35 U.S.C. 154(b) by 0 days.

(21) Appl. No.: 17/747,554

(22) Filed: May 18, 2022

(51) Int. Cl.
*G10D 7/14* (2020.01)

(52) U.S. Cl.
CPC ..... *G10D 7/14* (2020.02)

(58) Field of Classification Search
CPC ..... G10D 7/14
See application file for complete search history.

(56) References Cited

U.S. PATENT DOCUMENTS 863,960 A * 8/1907 Yates ..... G10D 7/14 84/377
2,276,501 A * 3/1942 Manieri ..... G10D 7/14 84/377
2,511,302 A * 6/1950 Stephenson ..... G10D 7/14 984/137
2,591,023 A * 4/1952 Stephenson ..... G10D 7/14 84/403
3,580,125 A * 5/1971 Heatwole ..... G10D 7/14 984/137
4,237,766 A * 12/1980 Marshall ..... G10D 7/14 984/137
5,166,461 A * 11/1992 Salwitz ..... G10D 7/14 84/377
5,413,021 A * 5/1995 Margetson ..... G10D 7/12 84/377
8,153,875 B1 * 4/2012 Beauregard ..... G10D 7/14 84/330
8,431,807 B1 * 4/2013 Beauregard, IV ..... G10D 9/00 84/377
11,610,566 B2 * 3/2023 Müller ..... G10D 7/14

* cited by examiner

*Primary Examiner* — Robert W Horn

(57) ABSTRACT

A harmonica with a repeating major scale configured across the draw reeds and a repeating major scale a half step lower than the draw reeds configured across the blow reeds. This configuration produces a chromatic instrument where all the notes of a major scale can be bent down to the next lower scale tone for musicality. The linear scale configuration provides trill and glissando sections for ease of playability and musicality.

1 Claim, No Drawings

MELODIC BEND HARMONICA

CROSS-REFERENCE TO RELATED APPLICATIONS

This application claims the benefit of provisional patent application No. 63/197,841, filed Jun. 07, 2021 by the present inventor.

TECHNICAL FIELD

The present invention relates to the harmonica, and more particularly to its note arrangement, its "tuning".

BACKGROUND

There are various harmonica tunings for playing the major scale (Table 1). Table 2 charts the C major scale on a Key of C Richter (standard) harmonica. Having only two bends, it sounds quite bland (the top octave B blow bend is nearly impossible to achieve). Table 3 charts Solo tuning. It has no bends.

Bends better emulate the human voice. All pitches between the bendable note and the bent note(s) are attainable. Slide whistle like travel is possible. Unbendable notes are like a piano in that their pitch can't be varied.

Neither of these tunings/harmonicas are chromatic, all twelve notes aren't present. Neither provide any trill or glissando sections. Thus, musical lines sound choppy, not smooth/legato. I will use the term "trill" for any two adjacent consecutive scale tones on blow or draw cavities/holes. Table 4 illustrates a trill section in C major. The stylistic effect of moving between these two cavities with celerity is called a trill. Table 4 also illustrates the same two notes arranged so they are not a trill. The blow, draw configuration cannot produce a trill effect.

I will use the term "glissando" for any three or more adjacent consecutive scale tones on blow or draw cavities. Table 5 illustrates a C Major 4-note draw glissando section and the same 4 notes configured so they are not a glissando. The notes of a glissando section can be executed with celerity and grace unattainable with a blow, draw, blow, draw combination. The presence of trill and glissando sections promotes ease of playability and musicality.

TABLE 1

| | | | | | | | |
|---|---|---|---|---|---|---|---|
| Half steps ----- | \| | \| | \| | \| | \| | \| | \| | \| | \| | \| | \| | \| |
| Major Scale | 1 | | 2 | | 3 | 4 | 5 | | 6 | | 7 | |
| | (Tonic) | | | | | | | | | | | |

TABLE 2

| Richter Tuning C major | | | | | | | | | | |
|---|---|---|---|---|---|---|---|---|---|---|
| | | | | | | | | | B | ← half step draw bends |
| C | E | G | C | E | G | C | E | G | C | |
| D | G | B | D | F | A | B | D | F | A | |
| | F | A | | | | | | | | ← whole step draw bends |

TABLE 3

| Solo Tuning C major | | | | | | | | | |
|---|---|---|---|---|---|---|---|---|---|
| C | E | G | C | C | E | G | C | C | E |
| D | F | A | B | D | F | A | B | D | F |

TABLE 4

| Trill | | | | | Not Trill | | | | |
|---|---|---|---|---|---|---|---|---|---|
| C | D | | | | C | | | | |
| | | | | | D | | | | |

TABLE 5

| Glissando | | | | | | Not Glissando | | | |
|---|---|---|---|---|---|---|---|---|---|
| | | | | | | C | E | | |
| C | D | E | F | | | D | F | | |

ADVANTAGES

This instrument is designed primarily to play the major scale. You can bend to and from every scale tone of the major scale on this instrument. This creates a pleasing sound, mimicking the human voice. It makes it sing. It is also novel in that the tonic major scale is configured in a linear fashion (all draws) as opposed to the common blow, draw, blow, draw pattern. This gives us the ability to employ trills and glissandos for musicality and ease of playability. It can also play the chromatic scale (all twelve notes) by solely employing blows and draws. Thus, it can comfortably play every scale conceivable. It can also play all conceivable scales with a combination of blows and/or draws and bends.

DETAILED DESCRIPTION

Melodic bend (Table 6) has a major scale configured across the draw reeds and a major scale a half step lower than the draw reeds configured across the blow reeds.

TABLE 6

| Melodic Bend Key of C | | | | | | | | | | |
|---|---|---|---|---|---|---|---|---|---|---|
| $F_{\#}$ | $G_{\#}$ | $A_{\#}$ | B | $C_{\#}$ | $D_{\#}$ | E | $F_{\#}$ | $G_{\#}$ | $A_{\#}$ | |
| A | B | C | D | E | F | G | A | B | C | |
| $G_{\#}$ | $A_{\#}$ | B | $C_{\#}$ | $D_{\#}$ | E | $F_{\#}$ | $G_{\#}$ | $A_{\#}$ | B | ← half step draw bends |
| G | A | | C | D | | F | G | A | | ← whole step draw bends |

Blow reeds - B major
Draw reeds - C major

OPERATION

Table 7 charts the C Major scale on a Key of C Melodic Bend Harmonica. There is technically a B and E on the blow reeds (Table 8) but table 7 is used for clarity. C major has 9 trill sections and a 10-hole glissando section. All notes can be bent down to the next scale tone for musicality. Table 9 charts Melodic Bend Harmonica by scale degrees.

TABLE 7

| | | | | | | | | | |
|---|---|---|---|---|---|---|---|---|---|
| A | B | C | D | E | F | G | A | B | C |
| | | B | | | E | | | | B |
| G | A | | C | D | | F | G | A | |

TABLE 8

| | | | | | | | | | |
|---|---|---|---|---|---|---|---|---|---|
| | | | B | | | E | | | |
| A | B | C | D | E | F | G | A | B | C |
| | | B | | | E | | | | B |
| G | A | | C | D | | F | G | A | |

TABLE 9

| | | | | | | | | | |
|---|---|---|---|---|---|---|---|---|---|
| 5b | 6b | 7b | 7 | 2b | 3b | 3 | 5b | 6b | 7b |
| 6 | 7 | 1 | 2 | 3 | 4 | 5 | 6 | 7 | 1 |

CONCLUSION, RAMIFICATIONS, AND SCOPE

The reader will see that this instrument provides many trill and glissando sections for ease of playability and musicality. It also features the ability to bend to and from every note of the major scale, making it sing. Being chromatic, it can play every scale conceivable. Though the above examples are in a certain key with the tonic on a certain hole, this harmonica can be made in all keys and the tonic can be placed on any hole.

I claim:

1. A harmonica comprising a body providing a series of adjacent cavities and a plurality of reeds each of which is responsive to the passage of air to produce a musical note of a predetermined pitch, two reeds being associated with each cavity such that one reed is the blow reed responsive to blowing on said cavity and the other is the draw reed responsive to drawing on said cavity, said harmonica being characterized in that:

(a) said draw reeds are constructed and arranged such that their predetermined pitches starting on a predetermined cavity produce the scale degrees 1,2,3,4,5,6,7 in a repeating pattern and (b) said blow reeds are constructed and arranged such that their predetermined pitches starting on said predetermined cavity produce the scale degrees 7b,7,2b,3b,3, 5b,6b in a repeating pattern.

* * * * *